United States Patent [19]

Lunt

[11] Patent Number: 4,744,118

[45] Date of Patent: May 17, 1988

[54] DISPOSABLE FITTED CRIB OR BED SHEET

[76] Inventor: Audrey T. Lunt, 6371 Vermont Hill Rd., South Wales, N.Y. 14139

[21] Appl. No.: 45,288

[22] Filed: May 4, 1987

Related U.S. Application Data

[63] Continuation-in-part of Ser. No. 932,612, Nov. 20, 1986, Pat. No. 4,704,753.

[51] Int. Cl.[4] ..... A47G 9/00

[52] U.S. Cl. ..... 5/487; 5/497; 156/73.1; 156/227

[58] Field of Search ..... 5/487, 497, 499, 500, 5/502, 495, 484, 482; 156/73.1, 227

[56] References Cited

U.S. PATENT DOCUMENTS

| | | | |
|---|---|---|---|
| 2,963,715 | 12/1960 | Young | 5/497 |
| 3,321,782 | 5/1967 | Hrubecky et al. | 5/497 |
| 3,681,795 | 8/1972 | Palenske et al. | 5/497 |
| 4,338,693 | 7/1982 | Vitale | 5/497 |

FOREIGN PATENT DOCUMENTS

| | | | |
|---|---|---|---|
| 2012159 | 7/1979 | United Kingdom | 5/484 |

*Primary Examiner*—Alexander Grosz
*Attorney, Agent, or Firm*—Michael Ebert

[57] ABSTRACT

A fitted sheet for covering a standard crib or bed mattress. The fitted sheet is developed from a single rectangular blank of non-woven fabric material, the sides of which are folded in along parallel longitudinal fold lines to form a folded-in sheet whose width corresponds to that of the mattress for which it is intended and whose length exceeds that of the mattress to an extent necessary to define the ends of the fitted sheet. Each corner of the folded-in sheet is seamed along a diagonal line to form a triangular flap which when the sides of the folded-in sheet are folded over the sides of the mattress, then defines a right angle corner that fits against the corresponding corner of the mattress. Each end of the fitted sheet is rendered stretchable by an elastic strip whereby the fitted sheet conforms snugly to the mattress.

5 Claims, 2 Drawing Sheets

Fig. 3.
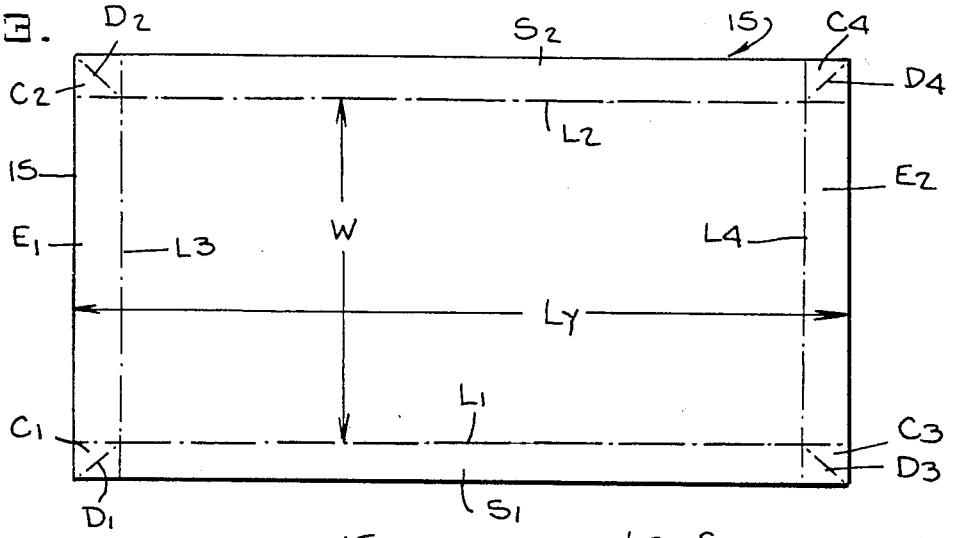
Fig. 4.
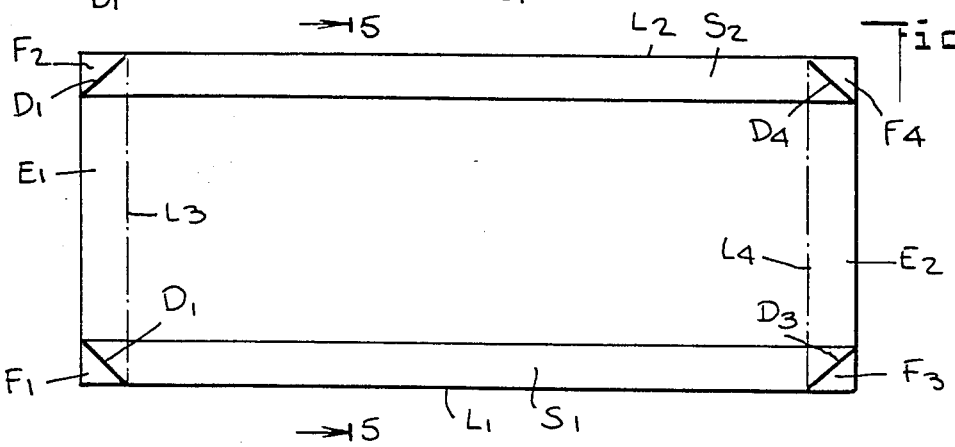
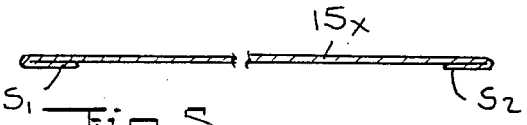
Fig. 5.
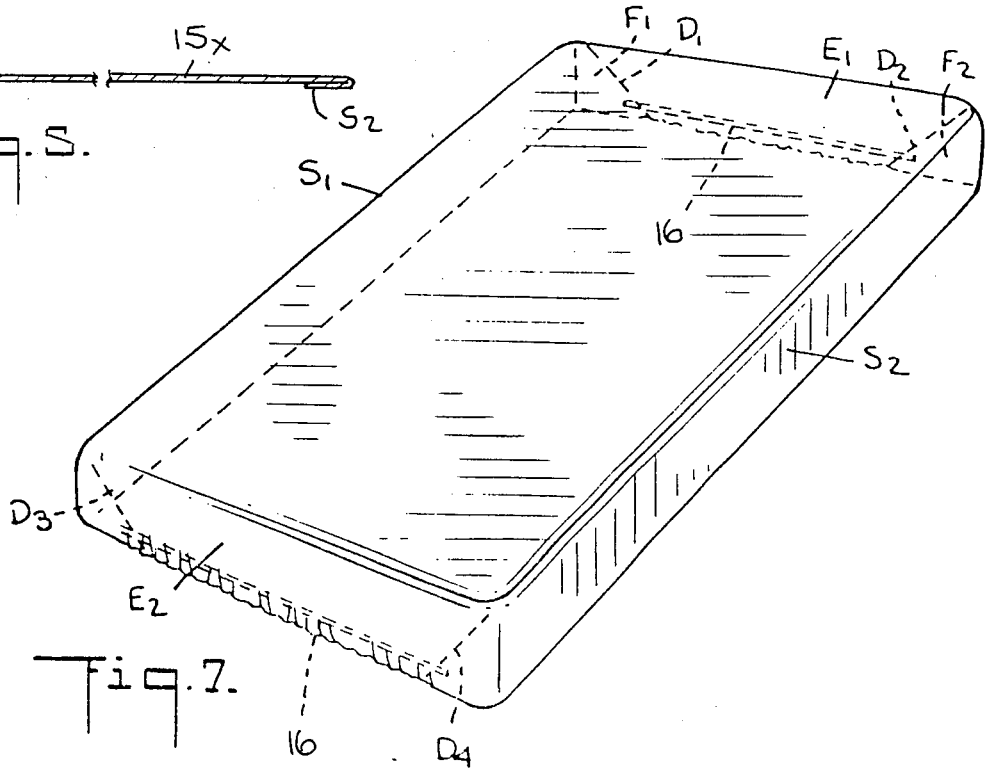
Fig. 7.

DISPOSABLE FITTED CRIB OR BED SHEET

RELATED APPLICATION

This application is a continuation-in-part of my copending application Ser. No. 932,612, filed Nov. 20, 1986, now U.S. Pat. No. 4,704,753 entitled "Fitted Crib or Bed Sheet," the entire disclosure of which is incorporated herein by reference.

BACKGROUND OF INVENTION

1. Field of Invention

This invention relates generally to crib or bed sheets, and in particular to an inexpensive and disposable fitted sheet that snugly conforms to a standard crib or bed mattress, the fitted sheet being made from a single flat blank of non-woven material in a manner that lends itself to automation.

2. Prior Art:

Infants and very young children are normally bedded down in a crib which is a bedstead enclosed by high slatted sides. The crib is provided with a mattress which is protectively covered by a crib sheet. An infant or young child occupying the crib will almost invariably wet or soil the crib sheet; hence the crib sheet must be repeatedly washed. The ordinary crib sheet is fabricated of woven cotton or other natural or synthetic textile fibers, or a composite thereof. In fitting the sheet to the mattress, one must fold and otherwise manipulate the sheet to form corners which conform to the corners of the mattress.

The same situation is encountered with ordinary bed sheets used in hospitals, nursing homes and in other places where the occupant of the bed is incontinent and therefore soils the sheet covering the bed mattress. Such crib sheets must be washed and sterilized after every use, a procedure that adds to operating expenses.

In a crib, the mattress is below the level of the slatted sides even when the sides are lowered; hence it is more difficult to form crib sheet corners than when forming corners on ordinary bed sheets. To overcome this difficulty, it is known to provide crib sheets as well as bed sheets with preformed corners, as disclosed, for example, in the Bogle patent 4,161,044. In making such fitted sheets, Bogle cuts a sheet to create a main rectangular panel and side and end panels which depend from the main panel and are sewn thereto to form right angle corners. The manufacture of such a fitted sheet requires cutting and sewing operations and is therefore relatively expensive.

When the infant or child occupying the crib is ill, then conventional washing procedures may not be sufficient to insure sterility and avoid possible reinfection because of inadequately cleaned crib sheets. It is for this reason that in a serious illness, even though conventional crib sheets are relatively costly, the usual practice is to dispose of the sheets after a single use.

Another problem encountered with crib sheet arises when one is traveling with a child. While many hotels and motels supply cribs having mattresses and crib sheets, one has no idea who previously occupied the crib, or whether the crib equipment is sanitary. Hence the better practice in this situation is to bring along fresh and clean crib sheets and to thereafter dispose of these crib sheets. But the cost of conventional crib sheets is such as to render this practice extravagant, particularly if more than one child is involved.

The above-identified copending patent application discloses a fitted crib sheet that is created without any cutting or sewing operations from a single blank of washable, synthetic plastic material. This blank is converted into a three-dimensional fitted sheet by folding operations and ultrasonic sealing. Because the fitted sheet makes use of inexpensive material and can be made at low cost, one may dispose of the sheet after a single use, as may be desirable when sterility is of great concern, or where it is inconvenient to wash the sheet so that it can be reused.

In the fitted sheet disclosed in my copending application, the sides of a single rectangular blank are folded in on longitudinal fold lines and its ends are folded in on transverse fold lines. Then the corners of the blank are folded in on diagonal fold lines to form triangular folds that are ultrasonically sealed to the folded-in ends, thereby defining a boxlike fitted sheet having reinforced right angle corners and sides and ends coextensive with those of the mattress. Each end of the fitted sheet is creased to form puckers that are joined to an elastic strip to render the end stretchable whereby the fitted sheet conforms snugly to the mattress.

A fitted crib sheet so formed is easy for a user to apply to a mattress, and it conforms snugly thereto so that it is not dislodged by a restless occupant who thrashes about the crib or bed. However, because the fitted sheet is developed by folding in the sides as well as the ends and the corners of the blank, these operations do not lend themselves to automation, as a consequence of which the crib sheet is relatively expensive to manufacture.

Thus, paper bag-making machines are available in which a web of paper drawn from a large reel is continuously fed into a folder station wherein the sides of the web are folded in before the web is then cut into individual folded-in pieces which are further processed to form a bag. It is not possible to use such machines to carry out all of the necessary folding operations using non-woven sheeting rather than paper in making a crib sheet of the type disclosed in my pending patent application, for one cannot with this machine also provide the required end folds and the diagonal folds at the corners.

SUMMARY OF INVENTION

In view of the foregoing, the main object of the invention is to provide an inexpensive and disposable fitted sheet for covering a standard crib or bed mattress, the fitted sheet being developed from a single rectangular blank of non-woven fabric material without any cutting or sewing operations.

A significant advantage of the invention is that the fitted crib or bed sheet is developed from a single blank in a simple procedure that lends itself to mass production at low cost. Since the sheet material is inexpensive, the resultant fitted crib sheet can be manufactured and sold at low cost, so that the user, even though the fitted crib sheet is washable and sterilizable and is therefore reusable, can afford to dispose of the crib sheet after a single use and dispense with the need and bother of washing and resterilization.

Also an object of the invention is to provide a crib sheet having elasticized ends so that the fitted sheet conforms snugly to the mattress and is not easily dislodged therefrom.

Yet another object of the invention is to provide a fitted sheet which normally lies flat and can therefore be folded to create a compact package for shipment and storage.

Briefly stated, these objects are attained in a fitted sheet for covering a standard crib or bed mattress. The fitted sheet is developed from a single rectangular blank of non-woven fabric material, the sides of which are folded in along parallel longitudinal fold lines to form a folded-in sheet whose width corresponds to that of the mattress for which it is intended and whose length exceeds that of the mattress to an extent necessary to define the ends of the fitted sheet. Each corner of the folded-in sheet is seamed along a diagonal line to form a triangular flap which when the sides of the folded-in sheet are folded over the sides of the mattress, then defines a right angle corner that fits against the corresponding corner of the mattress. Each end of the fitted sheet is rendered stretchable by an elastic strip whereby the fitted sheet conforms snugly to the mattress.

OUTLINE OF DRAWINGS

For a better understanding of the invention as well as other objects and further features thereof, reference is made to the following detailed description to be read in conjunction with the accompanying drawings, wherein:

FIG. 3 shows the top face of the blank from which the fitted sheet is developed;

FIG. 4 shows the underface of the blank after the longitudinal sides have been folded in to create a folded-in sheet whose corners are ultrasonically seamed along diagonal lines;

FIG. 5 is a transverse section taken through the folded-in sheet;

FIG. 7 shows in perspective the outerside of the crib sheet.

DESCRIPTION OF INVENTION

Figure 1:
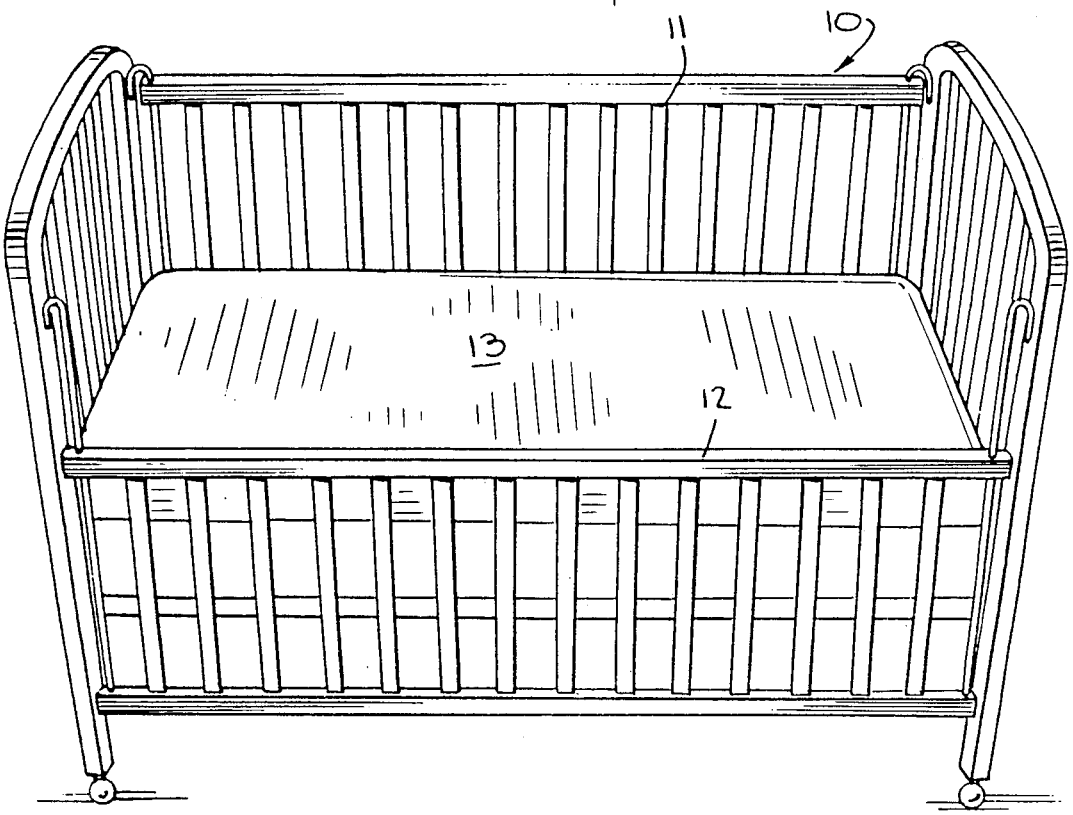
FIG. 1 is a perspective view of a conventional crib, the mattress of which is covered by a fitted crib sheet in accordance with the invention.
Figure 2:
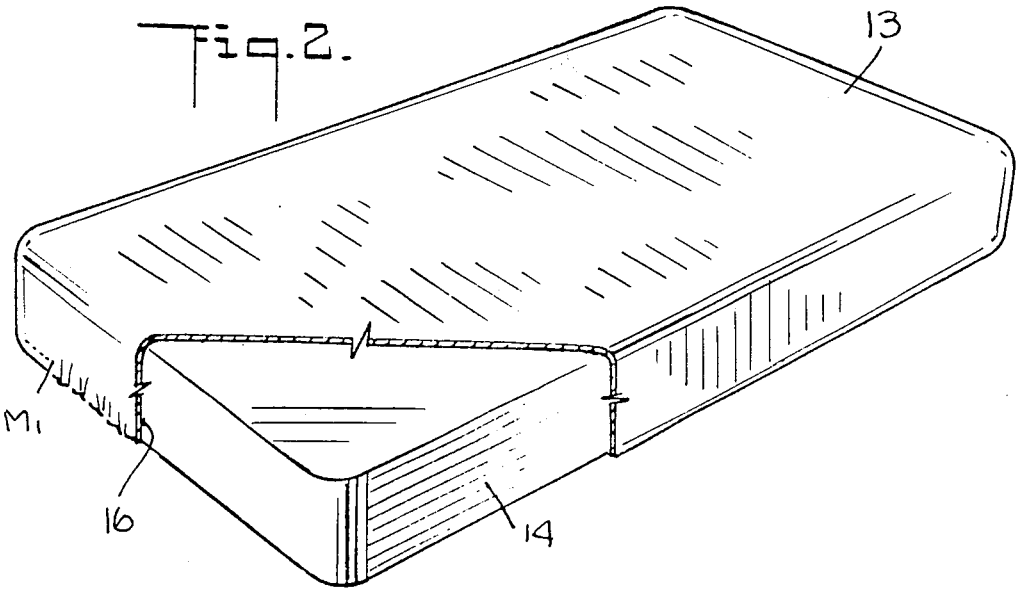
FIG. 2 is a perspective view of the crib mattress and of the crib sheet applied thereto which is cut away to expose the mattress.

Referring now to FIG. 1, there is shown a conventional crib 10 having slatted side panels 11 and 12 that can be raised to protect an occupant or lowered to provide access to a mattress which is covered by a fitted crib sheet 13 in accordance with the invention and is therefore not visible in FIG. 1. The mattress 14 is shown in FIG. 2. The dimensions for a standard mattress are 52 by 28 by 5 inches, in which case the fitted crib sheet has substantially the same dimensions. Because the fitted crib sheet 13 has preformed corners, there is no need to make these corners when covering a mattress with the crib sheet, for one has only to fit the preformed corners of the crib sheet over the corresponding corners of the mattress.

To create fitted sheet 13, use is made of a single rectangular blank 15, as shown in FIG. 3, cut from a web of fabric sheeting formed in whole or in part of non-woven synthetic plastic fibers which can be ultrasonically bonded or seamed. These fibers may be of polyester (Dacron), polyolefin, polyvinyl or any other type suitable for producing a non-woven fabric. Also usable are blends of cotton and polyester as well as tubular plastic fibers having entrapped air pockets therein to promote warmth and softness. In some instances, the air pockets in such fibers may be filled with flame retardant ingredients.

The sides $S_1$ and $S_2$ of blank 15 are folded in along longitudinal fold lines $L_1$ and $L_2$ to form a folded-in sheet 15X, as shown in FIG. 4. The width of sides $S_1$ and $S_2$ corresponds to those of the mattress for which the fitted sheet is intended; and the width of the folded-in sheet 15X is substantially equal to that of the mattress. The length $L_y$ of folded-in sheet 15X is substantially equal to that of the mattress. The length $L_y$ of folded-in sheet 15X exceeds the length of the mattress to the extent necessary to define the ends $E_1$ and $E_2$ of the fitted sheet, which ends correspond to those of the mattress.

Since a standard mattress in the example previously given has a 52 inch length, a 28 inch width and a 5 inch height, the blank from which a fitted sheet is created for this mattress has a 62 inch length and a 38 inch width. When blank 15 is folded in along longitudinal lines $L_1$ and $L_2$, the folded-in sheet has a 62 inch length and a 28 inch width. Hence each folded-in side $S_1$ and $S_2$ has a five inch width, and ends $E_1$ and $E_2$ of the sheet which extend beyond the length of the mattress each have a 5 inch width.

The four corners of folded-in sheet 15X are seamed ultrasonically or by heat and pressure along diagonal seam lines $D_1$, $D_2$, $D_3$ and $D_4$. Each diagonal seam line which acts to join folded in side $S_1$ or $S_2$ to the sheet, depending on which side forms the corner, extends at an angle between longitudinal fold line $L_1$ or $L_2$ and the adjacent end of the folded-in sheet 15X. Each diagonal line creates an equilateral corner flap ($F_1$, $F_2$, $F_3$ and $F_4$) whose base is defined by the diagonal line.

When the crib sheet is to be fitted onto a mattress, the folded-in sides $S_1$ and $S_2$ are folded over against the corresponding sides of the mattress, as shown in FIG. 7, to form right angle corners in which the triangular flaps $F_1$ and $F_4$ lie against the ends of the crib sheet. These right angle corners conform to the corners of the mattress, the sides and end of the crib sheet being co-extensive with those of the mattress.

Figure 6:
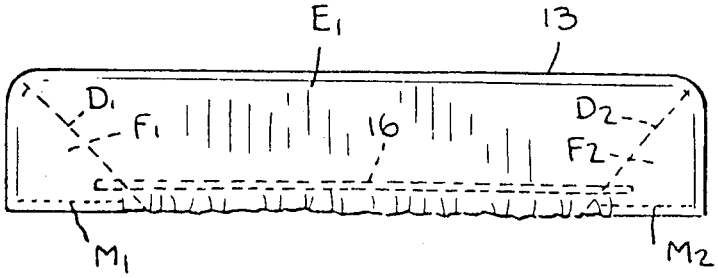
FIG. 6 is an exterior end view of the crib sheet.

As shown in FIG. 6, ends $E_1$ and $E_2$ are creased to form puckers. Extending across and bridging the puckers is a strip 16 of elastic material which is ultrasonically bonded to the peaks of the puckers and normally maintains the ends of the sheet in the puckered state. However, when the crib sheet is fitted over the crib mattress, the ends of the sheet must then be stretched, thereby subjecting the corners of the crib sheet to tension and causing the sheet to conform snugly to the mattress.

While the invention has been described in connection with a crib, it is also applicable to ordinary beds, in which case the fitted sheet is dimensioned to fit snugly over a standard bed mattress. As pointed out previously, the fitted sheet is particularly advantageous when the occupant of the bed is incontinent, in which case the sheet is provided with a porous, non-woven top layer laminated to an impermeable backing film.

While the backing film included in the fitted sheet material must be liquid-impermeable, it is desirable that it not be vapor-impermeable so that evaporated liquid can escape through the sheet. Thus, use is made for this purpose of vapor permeable plastic films of the type commonly used in raincoats and sportswear to keep the wearer dry while preventing the wearer from becoming clammy. A vapor-permeable and liquid-impermeable backing film reduces sheet dampness, and is therefore preferred to a film which is liquid and vapor-impermeable.

Instead of using a strip of elastic material to be joined ultrasonically to the puckers in the ends of the fitted sheet, use may be made of "Fullastic" self-adhering elastic ribbons for this purpose, this elastic material being disclosed in U.S. Pat. Nos. 4,259,220 and 4,418,123. This self-adhering elastic, which is produced in translucent ribbon form by H.B. Fuller Company of St. Paul, Minn. provides a flatter tensile/ elongation curve than natural rubber or urethane elastic and does away with the need to sew or seal an elastic strip to the puckers.

The reason a fitted sheet in accordance with the invention lends itself to automation is that the web of non-woven fabric from which the blanks are cut can be drawn from a supply reel and run continuously through a folding station of the type used in paper bag-making machines to fold in the long sides $S_1$ and $S_2$, after which the folded-in web is conducted through a cutting station in which the folded-in web is severed by a reciprocating blade to provide individual folded-in sheets 15X. These sheets then go to an ultrasonic seaming station in which the four diagonal seam lines $D_1$ to $D_4$ at the corners of sheet 15X are produced simultaneously. For this purpose, four ultrasonic welding heads are provided which reciprocate concurrently to engage the corner and then retract.

While there has been shown and described a preferred embodiment of a disposable fitted crib or bed sheet in accordance with the invention, it will be appreciated that many changes and modifications may be made therein without, however, departing from the essential spirit thereof.

I claim:

1. A fitted sheet for covering a standard crib or bed mattress having predetermined length, width and height dimensions, said sheet being developed from a single rectangular blank of non-woven, synthetic plastic fabric material which is ultrasonically sealable whose sides are folded in along parallel longitudinal fold lines to form a folded-in sheet whose width substantially corresponds to that of the mattress and whose length exceeds that of the mattress to an extent necessary to define the ends of the fitted sheet, the blank being cut from a continuous web after it has run through a folding station to fold in the sides, each corner of the folded-in sheet being thereafter ultrasonically seamed simultaneously in an ultrasonic seaming station along a diagonal line to form a triangular flap which, when the sides of the folded-in sheet are folded over the sides of the mattress, defines a right angle corner that fits against the corresponding corner of the mattress, the flap then lying against the end of the fitted sheet.

2. A fitted sheet as set forth in claim 1, wherein said fibers are polyester fibers.

3. A fitted sheet as set forth in claim 1, wherein said blank is formed of a porous and absorbent non-woven fabric sheet having an impermeable flexible plastic backing film laminated thereto to render the sheet waterproof.

4. A fitted sheet as set forth in claim 1, wherein said fibers are hollow and have entrapped air pockets therein.

5. A fitted sheet as set forth in claim 1, wherein each end of the fitted sheet is rendered stretchable by an elastic strip whereby the fitted sheet conforms snugly to the mattress.

* * * * *